US006430892B1

(12) United States Patent
Castaño

(10) Patent No.: US 6,430,892 B1
(45) Date of Patent: Aug. 13, 2002

(54) APPARATUS AND METHOD FOR BUILDING A DOMED STRUCTURE

(75) Inventor: Francisco Castaño, Houston, TX (US)

(73) Assignee: Geometrica, Inc., Houston, TX (US)

( * ) Notice: Subject to any disclaimer, the term of this patent is extended or adjusted under 35 U.S.C. 154(b) by 42 days.

(21) Appl. No.: 09/676,891

(22) Filed: Oct. 2, 2000

(51) Int. Cl.[7] ..... E04G 21/16; E04H 12/34
(52) U.S. Cl. ..... 52/745.08; 52/123.1
(58) Field of Search ..... 52/122.1, 123.1, 52/745.07, 745.08, 749.1, 80.1, 80.2, 81.1, 81.2, 81.3, 81.4, 81.5, 745.06

(56) References Cited

U.S. PATENT DOCUMENTS

| | | | | | |
|---|---|---|---|---|---|
| 1,032,284 | A | * | 7/1912 | Holland | 52/745.08 |
| 2,530,807 | A | * | 11/1950 | Campbell | 52/123.1 |
| 2,605,540 | A | * | 8/1952 | Kroll et al. | 52/123.1 |
| 2,670,818 | A | * | 3/1954 | Hacker | 52/745.07 |
| 2,708,012 | A | * | 5/1955 | Talcott | 52/123.1 |
| 2,862,252 | A | * | 12/1958 | Beach, Jr. | 52/123.1 |
| 3,092,216 | A | * | 6/1963 | Tye, Jr. | 52/122.1 |
| 3,185,265 | A | * | 5/1965 | White | 52/123.1 |
| 4,199,906 | A | * | 4/1980 | Jasch et al. | 52/80.1 |
| 5,724,775 | A | * | 3/1998 | Zobel, Jr. et al. | 52/81.5 |

OTHER PUBLICATIONS

Engineering News–Record, *320–ft Mojave Desert Dome Built From Center Outward*, Jun. 12, 1980.

* cited by examiner

*Primary Examiner*—Michael Safavi
(74) *Attorney, Agent, or Firm*—Haynes and Boone, LLP

(57) ABSTRACT

Apparatus for erecting a domed structure includes a support base and a guide member extending vertically from the support base. A lifting tower movably engages the guide member. The lifting tower is formed of sequentially added sections telescopingly mounted on the guide member. A plurality of push-up devices are mounted adjacent to the base. A first one of the push-up devices engages a first added section of the lifting tower. A second one of the push-up devices engages a second added section of the lifting tower. The first added section of the lifting tower is offset from the second added section of the lifting tower so that the lifting tower is vertically extended in a stepped sequence relative to the guide member. A dome formed of structural components extends radially outwardly from the lifting tower. A plurality of suspension members are attached to the lifting tower and extend radially outwardly into attachment with the dome, for elevating the dome in response to alternately actuating the first and second push-up devices.

26 Claims, 10 Drawing Sheets

APPARATUS AND METHOD FOR BUILDING A DOMED STRUCTURE

BACKGROUND

The disclosures herein relate generally to building structures and more particularly to lifting devices used in the building of structures.

It is well known that building structures and more specifically domed structures, are built using the assistance of a crane or lifting device which is centrally mounted relative to the dome to be constructed. The dome is built radially outwardly from the crane.

The crane comprises a vertical tower of considerable height. A lifting member is movably mounted relative to the vertical tower. The lifting member is advanced upwardly toward the top of the tower by being pulled from above.

A plurality of cables extend radially outwardly from the lifting member. The cables attach to the dome which is built from the top down such that sections are added to the outer periphery of the dome. As each section is added, the dome is raised by the lifting member so that another section can be added to the periphery of the dome.

In this manner, the dome is formed outwardly and downwardly by sequentially adding sections to the outer periphery of the dome which may have a circular or non-circular periphery.

As a result, the vertical tower must be constructed in its entirety and the lifting member attached thereto, before any construction is begun.

Therefore, what is needed is a tower which can be built progressively as needed to accommodate the expanding size of the dome being constructed.

SUMMARY

One embodiment, accordingly, provides a modularly constructed tower which is built in sections added to the base of the tower to accommodate the expanding height and girth of the dome. To this end, an apparatus for erecting a building structure includes a support base and a guide member mounted on the base. A lifting tower is elevatably mounted for movement on the guide member. The lifting tower is formed of sequentially added sections. A plurality of push-up devices alternately engage added sections of the lifting tower for elevating the lifting tower relative to the guide member. A portion of a building structure is formed of structural components. A suspension device is connected to the lifting tower and to the portion of the building structure for elevating the portion of the building structure in response to alternately actuating the push-up devices.

A principal advantage of this embodiment is that the tower does not need to stand at full height all of the time during construction. This minimizes exposure to wind loads, earthquakes, etc. The base provides stability to the lifting tower thus minimizing the need for extra foundations. The guide member provides stability and minimizes the need for extra guying. Also, there is no need to climb the structure or the tower during construction.

DETAILED DESCRIPTION

Figure 1:
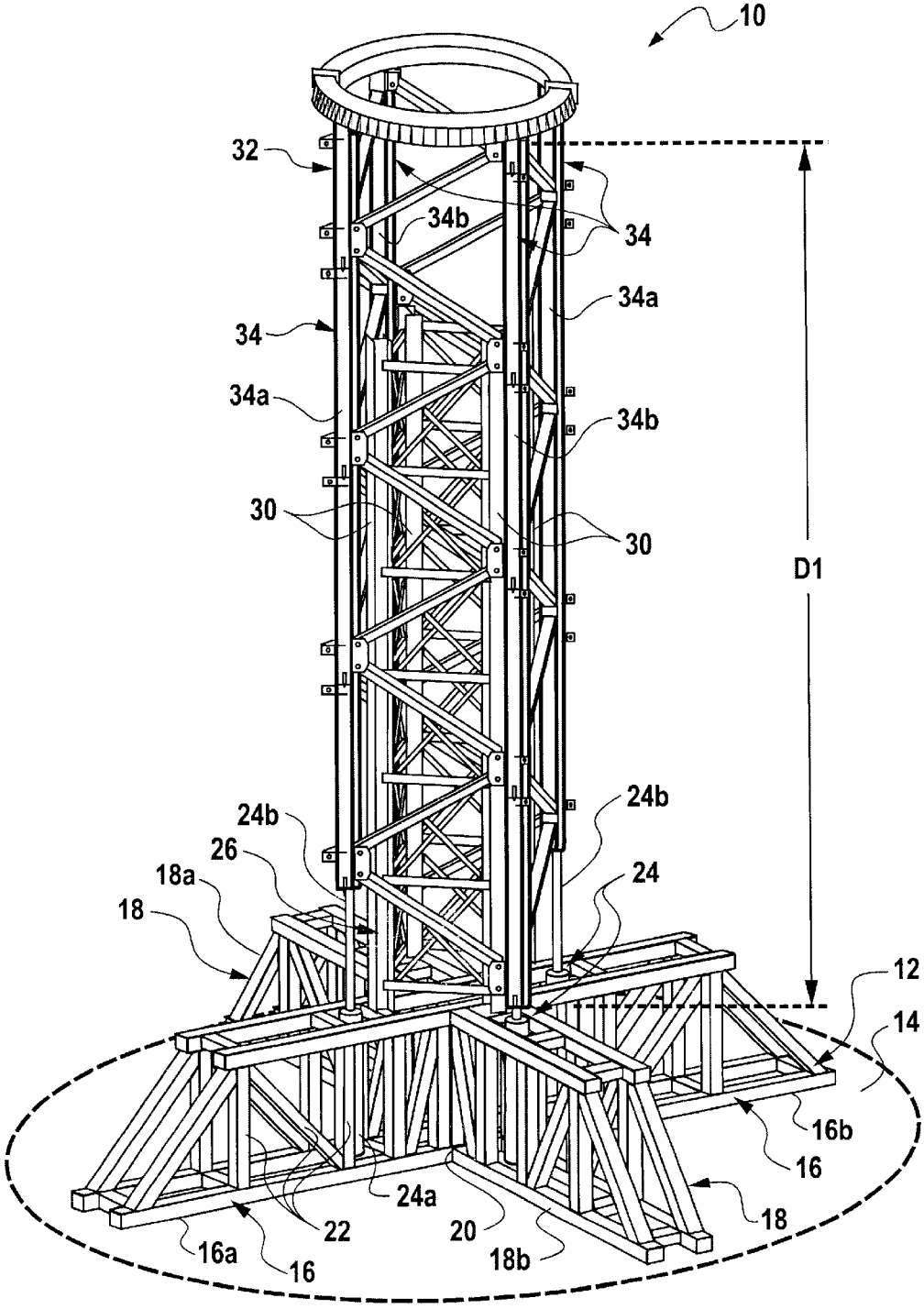
FIG. 1 is an isometric view illustrating an embodiment of a lifting tower.

A lifting apparatus is generally designed 10 in FIG. 1, and includes a support base 12 seated on a stabilizing pad 14 or other adequate support such as compacted soil to limit any tendency of base 12 to shift or tilt. Support base 12 includes a first main arm 16 and a second main arm 18 transversely disposed relative to first main arm 16. First main arm 16 is connected to second main arm 18 at center 20. The center 20 divides first main arm 16 into a pair of opposed arm members 16*a* and 16*b*. Similarly, the center 20 divides second main arm 18 into a pair of opposed arm members 18*a* and 18*b*. Each main arm 16 and 18 is formed as a truss including a plurality of structural steel members 22.

A commercially available hydraulic jack 24 is mounted in, or adjacent to, each of the respective arm members 16*a*, 16*b*, 18*a* and 18*b*. Each jack is vertically disposed and includes a cylinder 24*a* and a piston 24*b* which may be actuated to extend vertically from cylinder 24*a*. Each piston 24*b* may extend by the same distance as each other piston 24*b*, the distance being the length of the stroke of each piston 24*b*.

Figure 2:
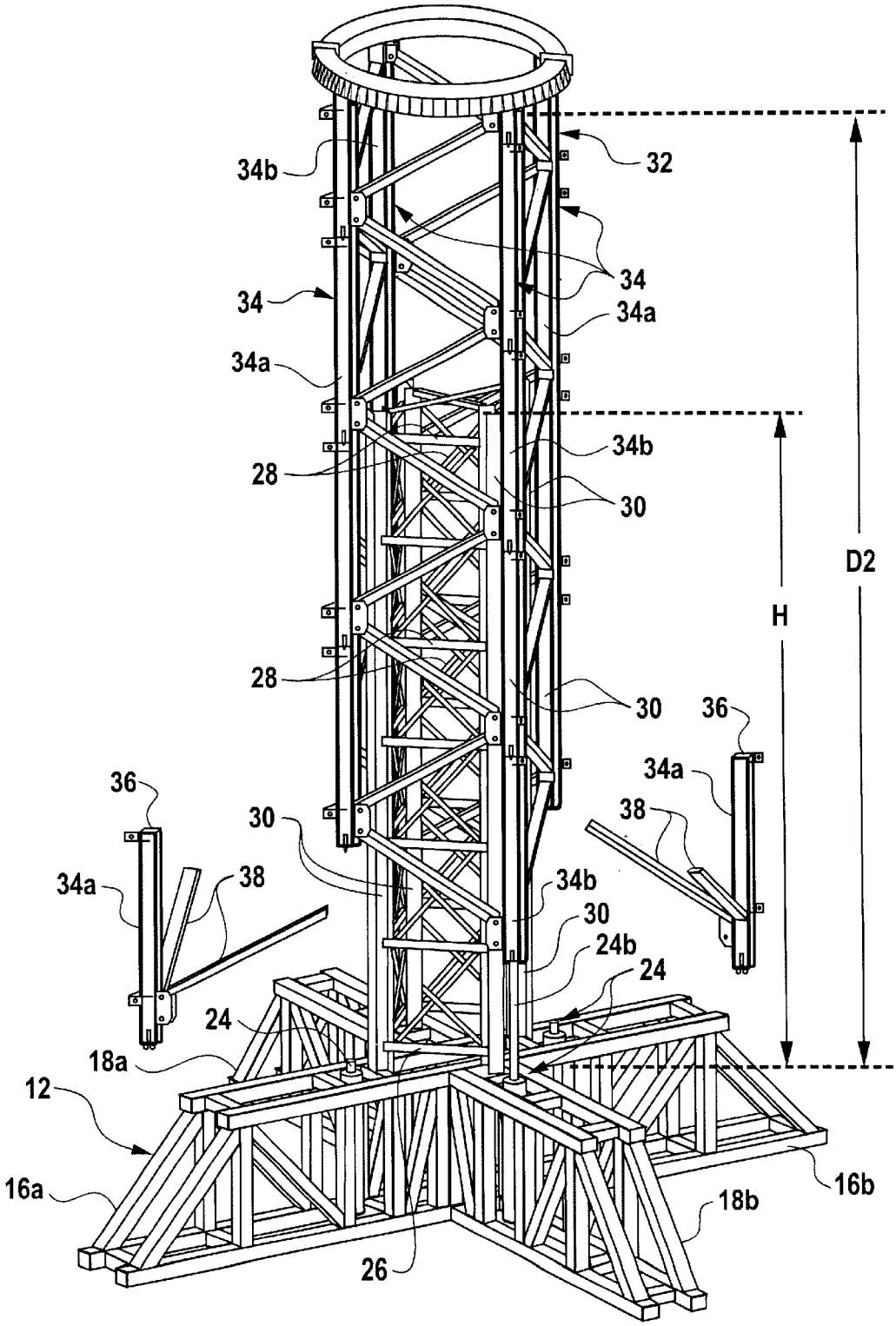
FIG. 2 is another isometric view illustrating the lifting tower if FIG. 1.

A guide member 26, FIG. 2, is mounted on the support base 12. Guide member 26 is fabricated from structural steel members including a plurality of main supports 30 connected to extend vertically from each respective arm member 16*a*, 16*b*, 18*a* and 18*b*. Each main support 30 is interconnected by a plurality of structural links 28 thus forming elongated guide member 26 having a rectangular cross-section and a fixed vertical height designated H.

A lifting tower 32 is mounted on guide member 26. Lifting tower 32 is fabricated from a plurality of opposed tower spiders 36. Each tower spider 36 is formed of a main support segment 34*a* and 34*b*, and a plurality of structural links 38. When the spiders 36 are vertically stacked, main support segments 34*a* and 34*b* form a plurality of opposed main supports 34. Tower 32 also extends vertically from the support base 12 and is formed to telescopingly slide over guide member 26. Each main support 34 of lifting tower 32 is adjacent a respective main support 30 of guide member 26. However, lifting tower 32 is not connected to support base 12 but has each main support 34 aligned with a respective jack 24 to permit each jack 24 to engage and push lifting tower 32 vertically relative to guide member 26.

Figure 3:
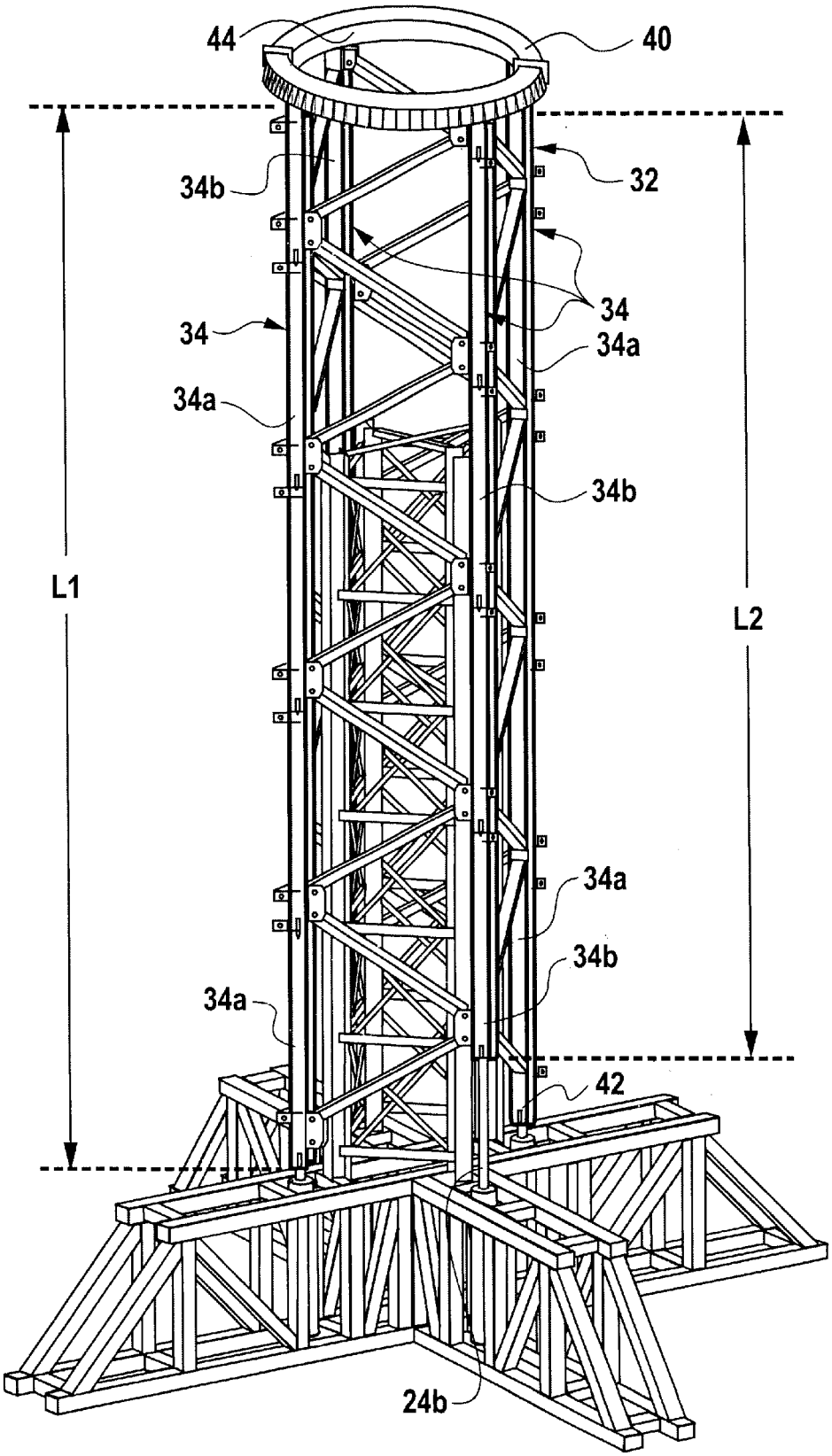
FIG. 3 is a further isometric view illustrating the lifting tower of FIGS. 1 and 2.
Figure 4:
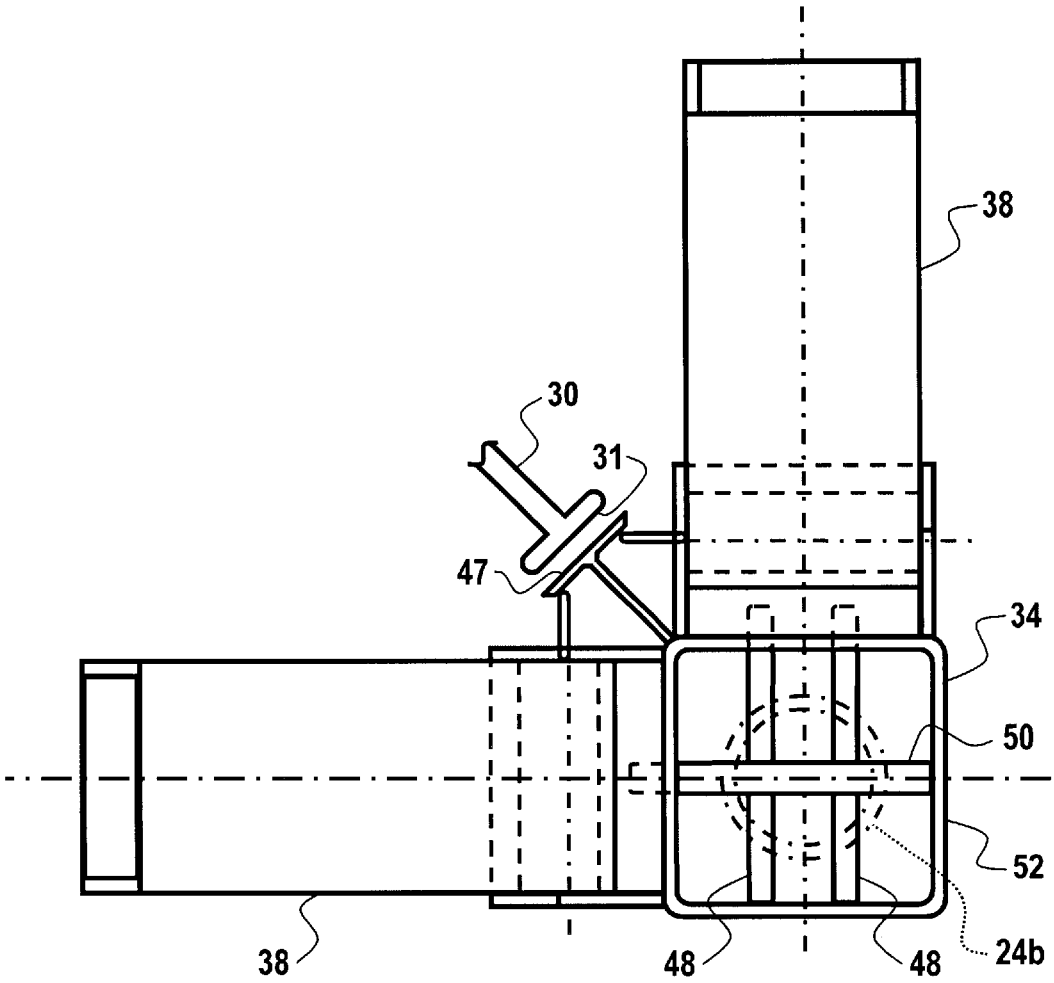
FIG. 4 is a partial sectional plan view illustrating an embodiment of the lifting tower.

Each main support 34, FIGS. 3 and 4, of the lifting tower 32 includes a continuous slide surface 47 which engages a face 31 of a respectively adjacent main support 30 of the guide member 26. This permits lifting tower 32 to slide with respect to guide member 26. Face 31 may also be substituted with rollers spaced regularly along the length of support 30.

Lifting tower 32 includes a lifting end 40 and a base end 42. The lifting end 40 includes a lifting ring 44. The base end 42 is formed of opposed pairs of the tower spiders 36. The first opposed pair of the tower spiders 36 includes segments 34*a* which are offset from the second opposed pair of the tower spiders 36 which includes segments 34*b*. As a result, the length L1 of the stacked opposed main supports 34*a* is greater than the length L2 of the stacked main supports 34*b*.

Figure 5:
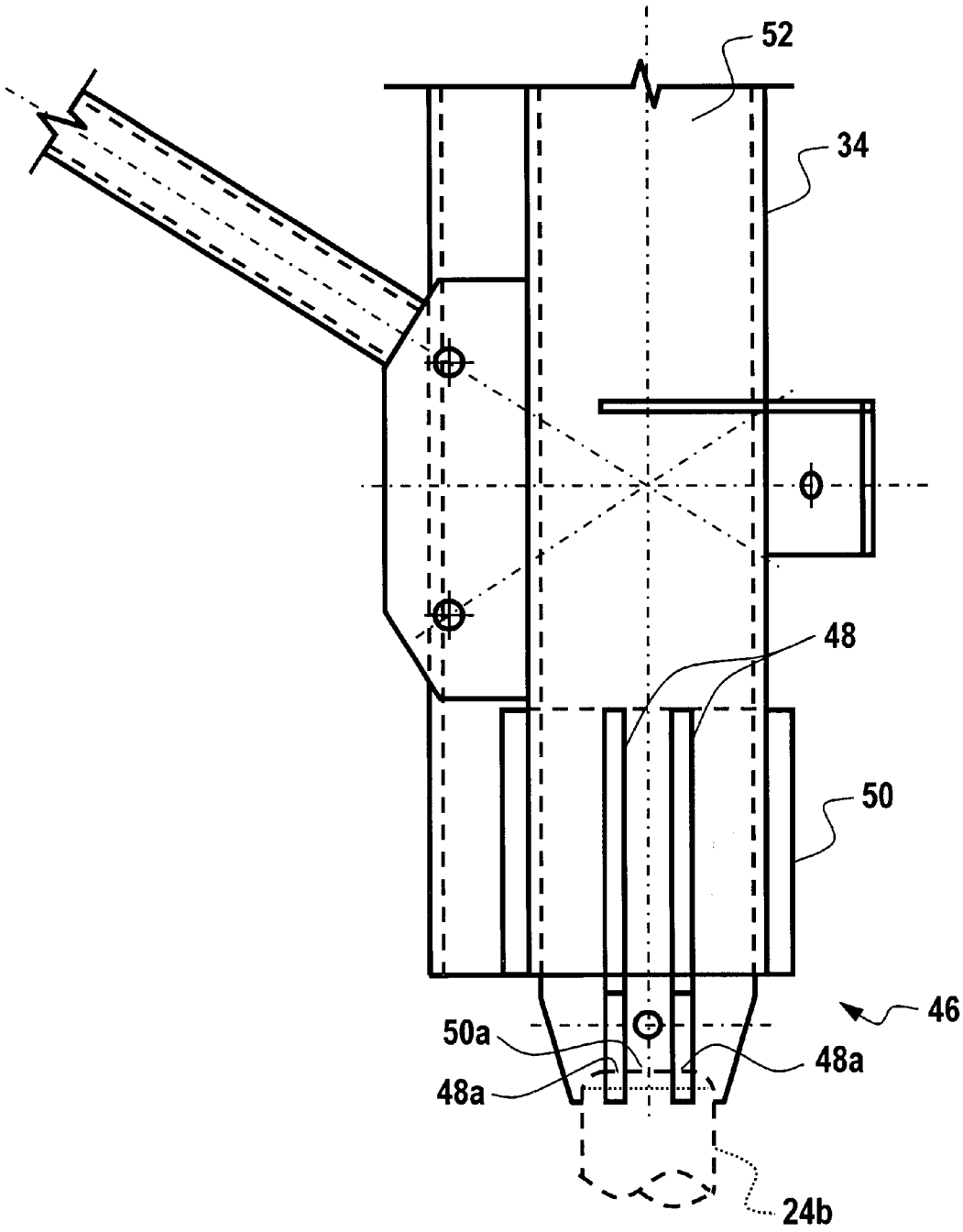
FIG. 5 is a partial sectional side view illustrating an embodiment of the lifting tower.

Each main support 34, FIGS. 4 and 5, of lifting tower 32 is a rectangular beam 52 which includes a jack engaging portion 46 for engagement with a respective piston 24*b*. Each jack engaging portion 46 is formed by a pair of parallel plates 48 attached to a transverse cross plate 50. Each of the parallel plates 48 and the cross plate 50 include a recess 48*a* and 50*a*, respectively to form a capture for engaging piston 24*b*.

In operation, FIGS. 1–3, the support base 12 is positioned on pad 14. Guide member 26 is connected to extend vertically from the support base 12. The lifting tower 32 is movably engaged with the guide member 26 such that the lifting tower 32 can be vertically elevated relative to the guide member 26. Hydraulic jacks 24 are alternately actuated and alternately engaged with the lifting tower 32. As a result, the first pair of the hydraulic jacks 24 are engaged with a first section of the lifting tower 32 which includes the segments 34*a*. Actuation of the first pair hydraulic jacks 24, FIG. 1, by means of pistons 24*b*, pushes the lifting tower 32 vertically to a first distance D1 from the support base 12. The second pair of the hydraulic jacks 24, FIG. 2, include pistons 24*b* which are actuated and engaged with the segments 34*b* thereby pushing the lifting tower 32 vertically to a second distance D2 from the support base 12. The second distance D2 is greater than the first distance D1. Thus, a second section of the lifting tower 32 is added. The second section includes the second pair of the tower spiders 36 which are offset from the first pair. Although each actuation of the hydraulic jacks 24 pushes the lifting tower 32 by a distance equal to the stroke of the pistons 24*b*, the cumulative effect is that the lifting tower 32 is incrementally raised relative to the support base 12 in segments. This action of vertically extending the lifting tower 32 in segments is also controlled by the pairs of tower spiders 36 which are added to the base end 42 of the lifting tower 32. The main supports 34*a* and 34*b* of each tower spider 36 have a length which is slightly less than the stroke of the pistons 24*b*. Additional sections may be added to the lifting tower 32 as described above, until the desired tower height is achieved.

Figure 6:
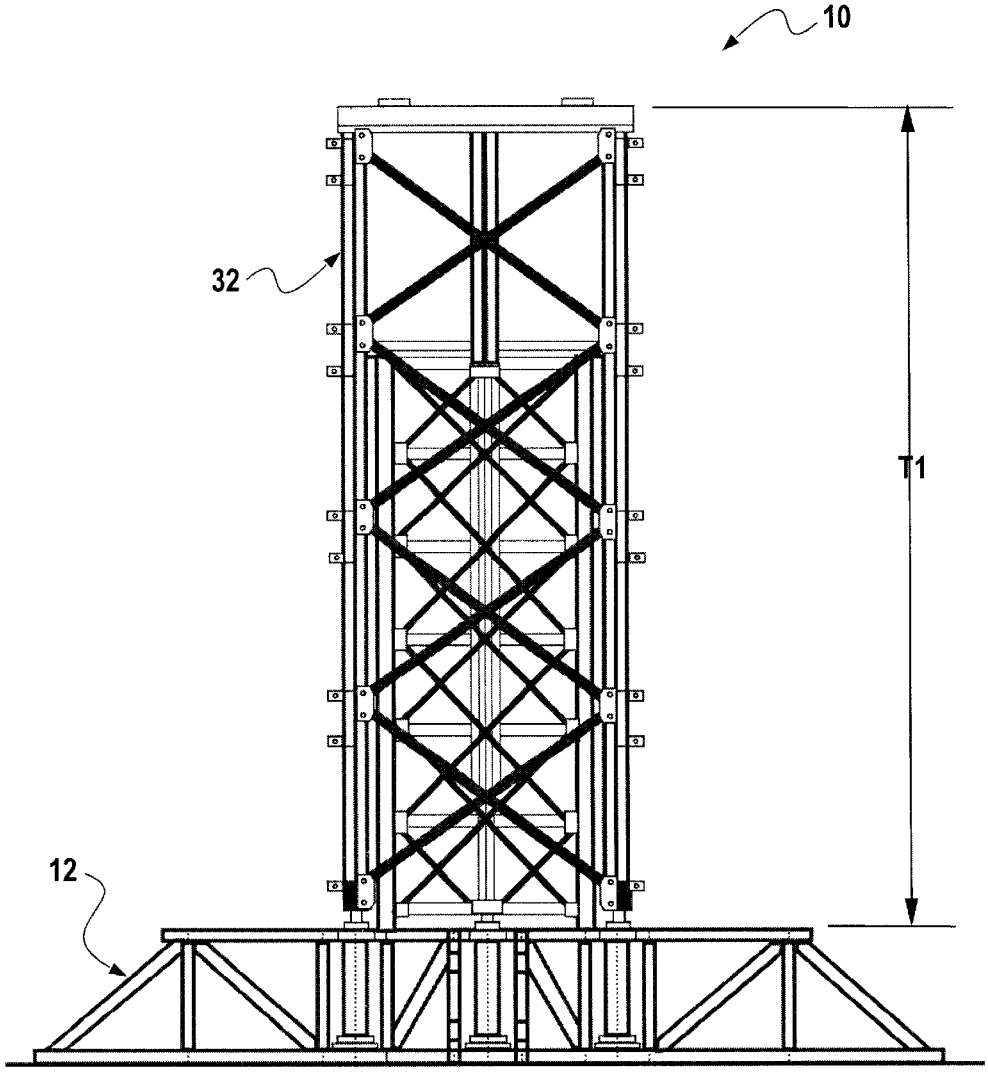
FIG. 6 is a side view illustrating an embodiment of an initial tower height.
Figure 7:
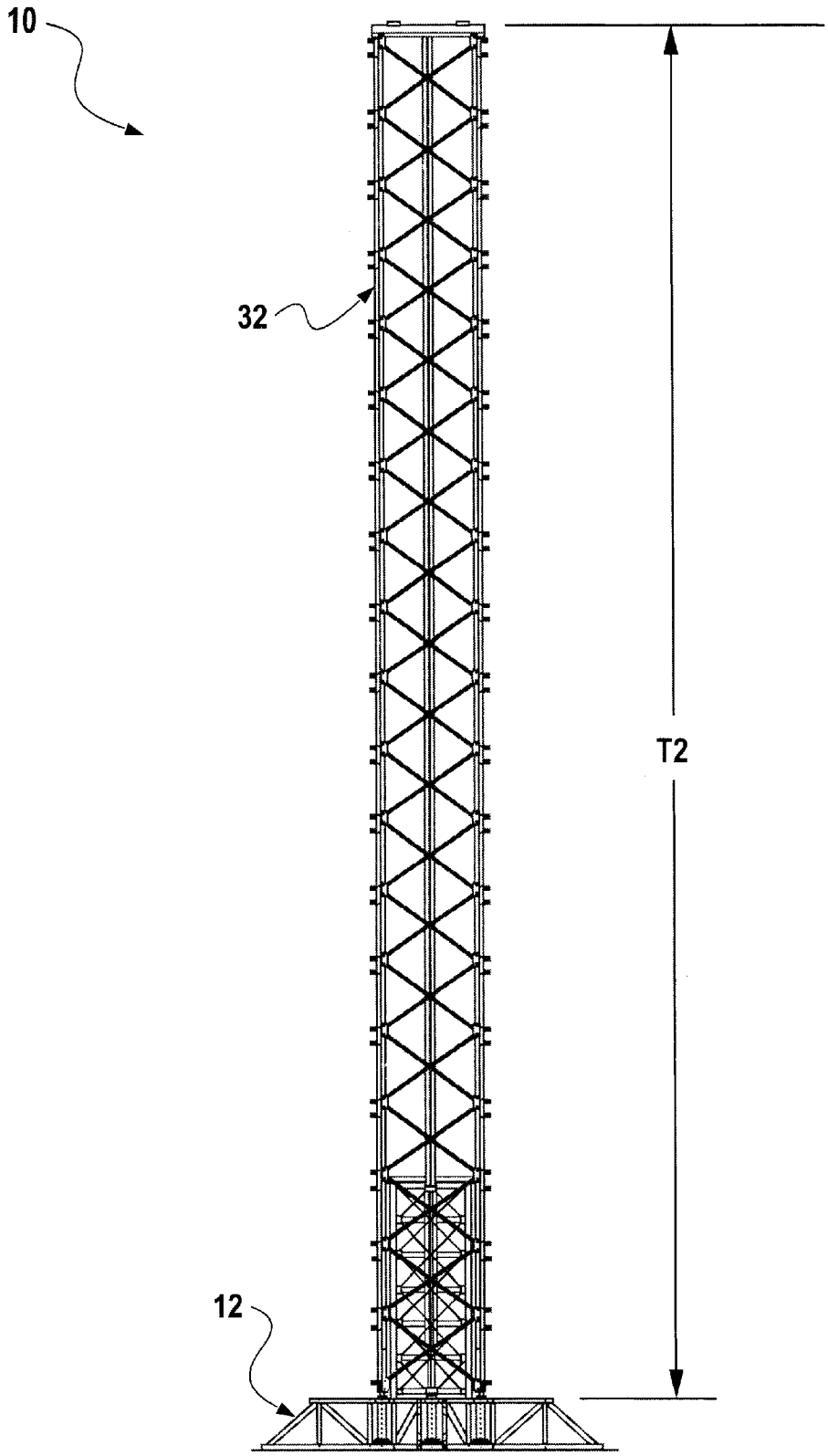
FIG. 7 is a side view illustrating an embodiment of a final tower height.

During the construction of a building structure, such as a domed structure, the lifting apparatus 10, FIG. 6, is built to an initial tower height T1, above support base 12 sufficient to begin construction of a dome. As additional sections are added to the lifting tower 32, a final tower height T2, FIG. 7, is reached at a height sufficient to complete the construction of a dome.

Figure 8:
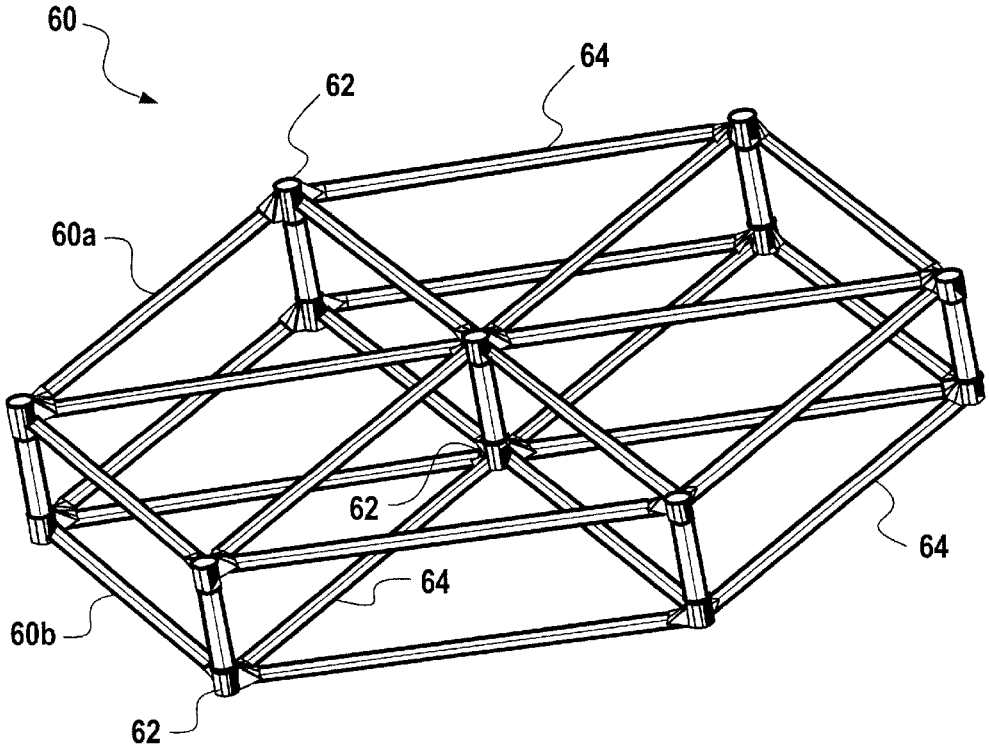
FIG. 8 is a perspective view illustrating an embodiment of a pre-assembled dome spider.

One method of constructing a building structure such as a dome is accomplished by the connection of pre-assembled dome spiders 60, FIG. 8. Each dome spider 60 includes a hub 62 joining several elongated tubular members 64. Dome spiders 62 may be interconnected in the form illustrated in FIG. 8 including a first dome layer 60*a* connected to a second dome layer 60*b* in a stacked, spaced apart relationship. In some instances, if preferred, only a first dome spider layer may be used.

Figure 9:
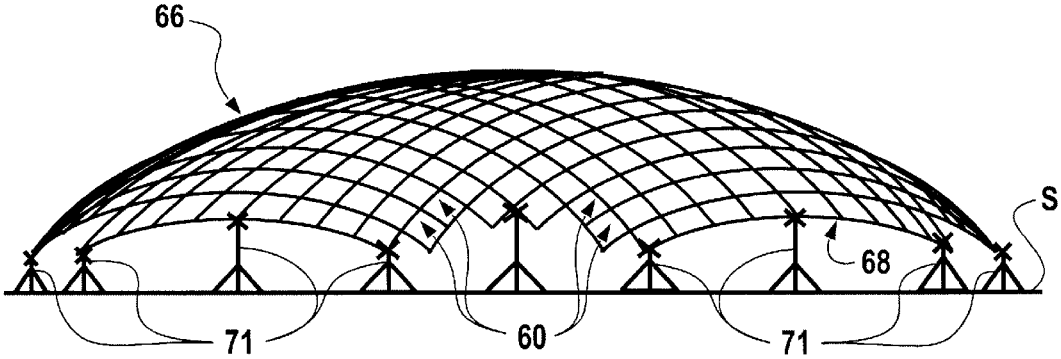
FIG. 9 is a side view illustrating an embodiment of a dome.

A dome 66, FIG. 9, is built radially outwardly and usually also downwardly. The dome spiders 60 are attached to an outer periphery 68 of dome 66 which is adjacent a plurality of support points 71 on a support surface S. The support surface 70 may include a finished structural support system (not shown) at or near ground level, or may include a finished vertical side wall (not shown) so that the dome 66 is supported well above ground level.

Figure 10:
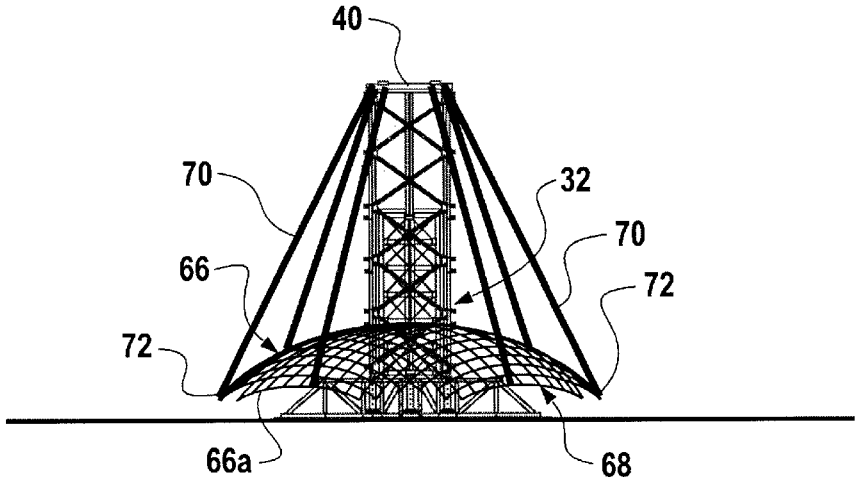
FIGS. 10–12 are side views illustrating an embodiment of a dome at various stages of completion.
Figure 11:
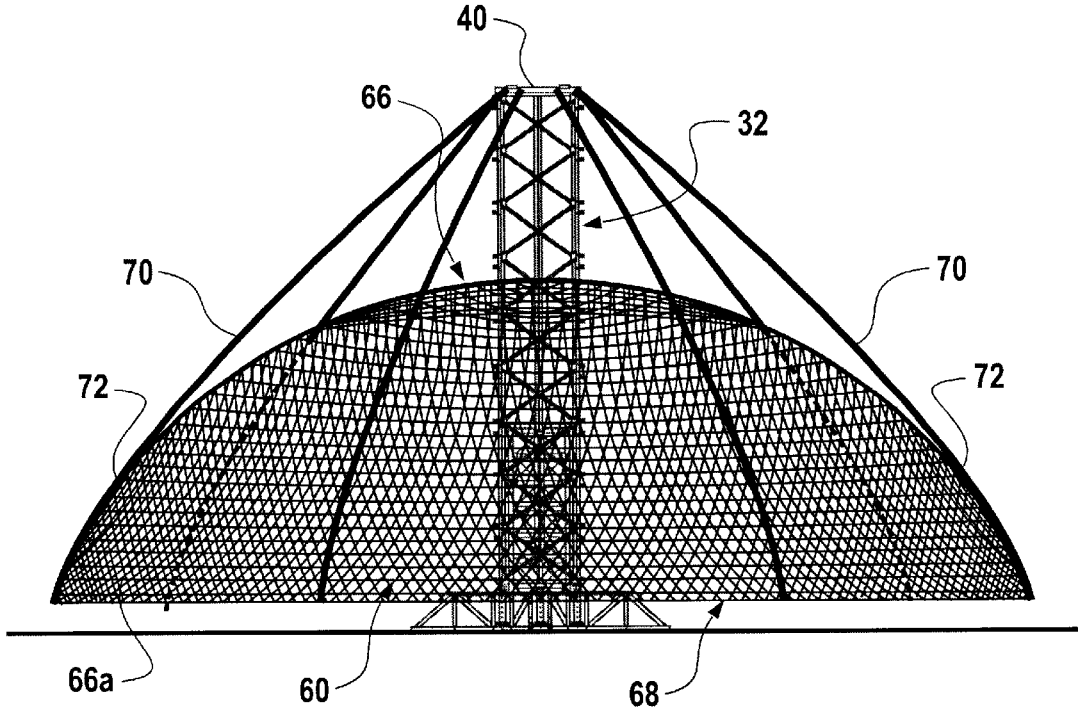
Figure 12:
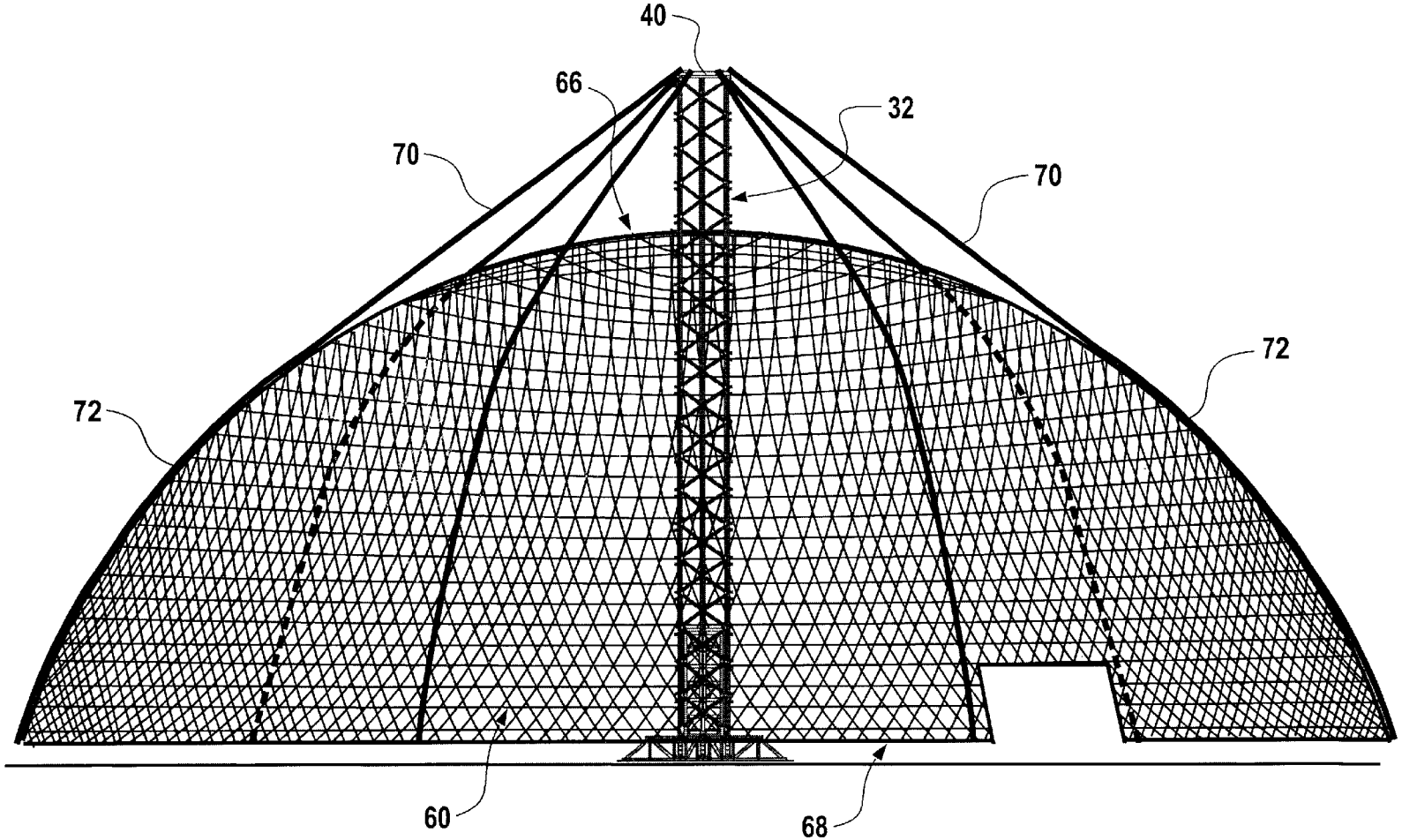

The dome 66, FIG. 10, is suspended from lifting tower 32 by means of a plurality of cables 70 extending radially outwardly from lifting ring 40 to attach to the outer periphery 68 of the dome 66. Preferably a connection point 72, between each cable 70 and the dome 66, is near tangent to an outer surface 66*a* of dome 66. Therefore, as the dome 66 is enlarged, and the lifting tower 32 is increased in height, FIGS. 11 and 12, due to the stepped sequential addition of dome spiders 60 to the outer periphery 68, the connection point 72 of each cable 70 is subject to being changed a few times throughout the construction of dome 66.

As a result, one embodiment provides an apparatus for erecting a building structure including a support base and a guide member mounted on the base. A lifting tower is elevatably mounted for movement on the guide member. The lifting tower is formed of sequentially added sections. A plurality of push-up devices alternately engage the added sections of the lifting tower for elevating the tower relative to the guide member. A portion of the building structure is formed of structural components, and suspension means are connected to the lifting tower and to the portion of the building structure for elevating the portion of the building structure in response to alternately actuating the push-up devices.

Another embodiment provides an apparatus for erecting a dome structure including a support base and a guide member extending vertically from the support base. A lifting tower movably engages the guide member. The lifting tower is formed of sequentially added sections. A plurality of push-up devices are mounted adjacent the base. A first one of the push-up devices engages a first added section of the lifting tower and a second one of the push-up devices engages a second added section of the lifting tower. The first added section of the lifting tower is offset from the second added section of the lifting tower. A dome, formed of structural components, extends radially outwardly from the lifting tower. A plurality of suspension members are attached to the lifting tower and extend radially outwardly into attachment with the dome.

A further embodiment provides a method of erecting a dome structure including positioning a support base on a surface and connecting a guide member to extend vertically from the support base. A lifting tower is movably engaged with the guide member. A first push-up device is engaged with a first section of the tower and the first push-up device is actuated for pushing the tower vertically to a first distance from the base. A second section is added to the tower. The second section is offset from the first section. A second push-up device is engaged with the second section of the tower. The second push-up device is actuated for pushing the tower vertically to a second distance from the base, greater than the first distance. A dome is formed from structural components assembled radially outwardly from the lifting tower. The dome is suspended by a plurality of suspension members attached to the lifting tower and extending radially outwardly into attachment with the dome for elevating the dome upon actuation of the push-up devices.

Another embodiment provides a method of erecting a building structure including positioning a support base on a surface and connecting a guide member to extend vertically from the support base. A lifting tower is movably engaged with the guide member. A plurality of push-up actuators are mounted adjacent the support base. The push-up actuators are alternately engaged with a first added section of the lifting tower and sequentially with a second added section of the lifting tower for elevating the lifting tower vertically relative to the guide member in a stepped sequence. A portion of the building structure is formed from interconnected structural components and is suspended from the lifting tower for elevating the portion of the building structure in response to alternately actuating the push-up actuators.

As it can be seen, the principal advantages of these embodiments are that the tower does not need to stand at full height all of the time during construction. This minimizes exposure to wind loads, earthquakes, etc. Less load is moved by the push-up method and the base provides stability to the lifting tower thus minimizing the need for extra foundations. The guide member provides stability and minimizes the need for extra guying. Also, there is no need to climb the structure or the tower during construction.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. Apparatus for erecting a building structure comprising:

a support base;

a guide member mounted on the base;

a lifting tower elevatably mounted for movement on the guide member, the lifting tower being formed of sequentially added sections;

a plurality of push-up devices alternately engaging the added sections of the lifting tower for elevating the lifting tower relative to the guide member;

a building structure portion formed of structural components; and suspension means connected to the lifting tower and to the building structure portion for elevating the building structure portion in response to alternately actuating the push-up devices.

2. The apparatus as defined in claim 1 wherein the support base includes a plurality of opposed arms.

3. The apparatus as defined in claim 2 wherein each push-up device is positioned adjacent a respective arm.

4. The apparatus as defined in claim 1 wherein the guide member extends vertically from the support base.

5. The apparatus as defined in claim 4 wherein the lifting tower extends vertically from the support base and telescopingly slides over the guide member, the building structure portion extending radially outwardly from the lifting tower.

6. The apparatus as defined in claim 5 wherein the added sections comprise a plurality of offset sections attached to the tower adjacent the support base.

7. The apparatus as defined in claim 6 wherein the push-up devices push the tower vertically from the support base.

8. The apparatus as defined in claim 1 wherein the lifting tower includes a first end adjacent the support base and a second end spaced apart from the support base, the building structure portion extending radially outwardly from the lifting tower.

9. The apparatus as defined in claim 8 wherein the second end of the lifting tower includes a lifting ring.

10. The apparatus as defined in claim 9 wherein the guide member extends vertically from the support base.

11. The apparatus as defined in claim 10 wherein the lifting tower extends vertically from the support base and telescopingly slides over the guide member.

12. The apparatus as defined in claim 11 wherein the added sections comprise a plurality of offset sections attached to the first end of the lifting tower adjacent the support base.

13. The apparatus as defined in claim 12 wherein the push-up devices push the lifting tower vertically from the support base.

14. Apparatus for erecting dome structure comprising:

a support base;

a guide member extending vertically from the support base;

a lifting tower movably engaging the guide member, the lifting tower being formed of sequentially added sections;

a plurality of push-up devices mounted adjacent the base, a first one of the push-up devices engaging a first added section of the lifting tower, and a second one of the push-up devices engaging a second added section of the lifting tower, the first added section of the lifting tower being offset from the second added section of the lifting tower;

a dome formed of structural components, the dome extending radially outwardly from the lifting tower; and a plurality of suspension members attached to the lifting tower and extending radially outwardly into attachment with the dome.

15. The apparatus as defined in claim 14 wherein the support base includes a plurality of opposed arms.

16. The apparatus as defined in claim 15 wherein each push-up device is positioned adjacent a respective arm.

17. The apparatus as defined in claim 14 wherein the lifting tower extends vertically from the support base and telescopingly slides over the guide member.

18. The apparatus as defined in claim 17 wherein the push-up devices push the tower vertically from the support base.

19. The apparatus as defined in claim 14 wherein the lifting tower includes a first end adjacent the support base and a second end spaced apart from the support base.

20. The apparatus as defined in claim 19 wherein added sections are attached to the first end of the lifting tower and the second end of the lifting tower includes a lifting ring.

21. The apparatus as defined in claim 14 wherein the dome is formed of pre-assembled modules.

22. The apparatus as defined in claim 21 wherein each pre-assembled module includes a hub and a plurality of elongated structural members connected to the hub.

23. The apparatus as defined in claim 21 wherein each pre-assembled module includes a first layer connected to a second layer spaced apart from the first layer, each layer including a hub and a plurality of elongated structural members connected to the hub.

24. A method of erecting a dome structure comprising the steps of:

positioning a support base on a surface;

connecting a guide member to extend vertically from the support base;

movably engaging a lifting tower on the guide member;

engaging a first push-up device with a first section of the tower;

actuating the first push-up device for pushing the tower vertically to a first distance from the base;

adding a second section to the tower, the second section being offset from the first section;

engaging a second push-up device with the second section of the tower;

actuating the second push-up device for pushing the tower vertically to a second distance from the base, greater than the first distance;

forming a dome from structural components assembled radially outwardly from the lifting tower; and suspending the dome from the lifting tower by a plurality of suspension members attached to the lifting tower and extending radially outwardly into attachment with the dome, whereby the dome is elevated in response to alternately actuating the first and second push-up devices.

25. The method as defined in claim 24 further comprising the steps of:

adding the structural components to expand an outer periphery of the dome when the tower is at the first distance from the base; and adding further structural components to further expand the outer periphery of the dome when the tower is at the second distance from the base.

26. A method of erecting a building structure comprising the steps of:

positioning a support base on a surface;

connecting a guide member to extend vertically from the support base;

movably engaging a lifting tower on the guide member;

mounting a plurality of push-up actuators adjacent the support base and in vertical alignment with the lifting tower;

alternately engaging the push-up actuators with a first added section of the lifting tower and sequentially with a second added section of the lifting tower for elevating the lifting tower vertically relative to the guide member in a stepped sequence;

forming a portion of a building structure from interconnected structural components; and suspending the portion of the building structure from the lifting tower for elevating the portion of the building structure in response to alternately actuating the push-up actuators.

* * * * *